United States Patent [19]

Lauritzen

[11] Patent Number: 4,504,023

[45] Date of Patent: Mar. 12, 1985

[54] APPARATUS PRODUCING CONSTANT CABLE TENSION FOR INTERMITTENT DEMAND

[75] Inventor: Ted Lauritzen, Lafayette, Calif.

[73] Assignee: The United States of America as represented by the United States Department of Energy, Washington, D.C.

[21] Appl. No.: 612,955

[22] Filed: May 23, 1984

[51] Int. Cl.[3] ..... B65H 75/00

[52] U.S. Cl. ..... 242/54 R; 242/57; 242/75.4; 254/268; 254/332

[58] Field of Search ..... 242/54 R, 57, 45, 67.1 R, 242/67.3 R, 75.5, 75.51, 75.4, 75.44; 254/268, 329, 332

[56] References Cited

U.S. PATENT DOCUMENTS

| | | | |
|---|---|---|---|
| 3,015,473 | 1/1962 | Frellsen | 254/268 |
| 3,504,891 | 4/1970 | Ulbing | 254/329 |
| 3,682,410 | 8/1972 | Rinearson | 242/45 X |
| 3,887,038 | 6/1975 | Buschbom et al. | 187/27 |
| 3,899,143 | 8/1975 | Slezak | 242/156.2 |
| 4,034,963 | 7/1977 | Warman et al. | 254/173 B |
| 4,318,533 | 3/1982 | Port | 254/273 |
| 4,347,993 | 9/1982 | Leonard | 242/75.51 |

*Primary Examiner*—Leonard D. Christian
*Assistant Examiner*—Stuart J. Maltzman
*Attorney, Agent, or Firm*—L. E. Carnahan; Roger S. Gaither

[57] ABSTRACT

The disclosed apparatus produces constant tension in superconducting electrical cable, or some other strand, under conditions of intermittent demand, as the cable is unreeled from a reel or reeled thereon. The apparatus comprises a pivotally supported swing frame on which the reel is rotatably supported, a rotary motor, a drive train connected between the motor and the reel and including an electrically controllable variable torque slip clutch, a servo transducer connected to the swing frame for producing servo input signals corresponding to the position thereof, a servo control system connected between the transducer and the clutch for regulating the torque transmitted by the clutch to maintain the swing frame in a predetermined position, at least one air cylinder connected to the swing frame for counteracting the tension in the cable, and pressure regulating means for supplying a constant air pressure to the cylinder to establish the constant tension in the cable, the servo system and the clutch being effective to produce torque on the reel in an amount sufficient to provide tension in the cable corresponding to the constant force exerted by the air cylinder. The drive train also preferably includes a fail-safe brake operable to its released position by electrical power in common with the servo system, for preventing rotation of the reel if there is a power failure. A shock absorber and biasing springs may also be connected to the swing frame, such springs biasing the frame toward its predetermined position. The tension in the cable may be measured by force measuring devices engageable with the bearings for the reel shaft, such bearings being supported for slight lateral movement. The reel shaft is driven by a Shmidt coupler which accommodates such movement.

20 Claims, 7 Drawing Figures

APPARATUS PRODUCING CONSTANT CABLE TENSION FOR INTERMITTENT DEMAND

The United States Government has rights in this invention pursuant to Contract No. DE-AC03-76SF00098 between the United States Department of Energy and the University of California.

FIELD OF THE INVENTION

This invention relates to apparatus for producing constant tension in cable or the like when it is unreeled and reeled from a drum or spool under conditions of intermittent demand. The invention is particularly applicable to the handling of superconductive cable, but the invention is also applicable to the unreeling and reeling of other strands, such as electrical cable, wire, cord, other cables, fish line, wrapping paper and numerous other materials.

BACKGROUND OF THE INVENTION

This invention is directed particularly to the problem of winding or wrapping magnet coils with superconducting cable or ribbon. In addition to being very expensive, superconducting cable is extremely sensitive to mechanical mistreatment, such as being stretched or jerked. Such mistreatment reduces the current-carrying cross sectional area of the cable along the length that has been subject to abuse. Superconductors can carry many thousands of amperes per square centimeter, but if the current-carrying capacity is exceeded, due to any unexpected reduction in cross sectional area in a length that has been stretched, that length may suddenly go into normal or resistive conductivity, rather than superconductivity, as the current is increased to its supposedly safe value. When this happens, heat is generated in the resistance of the cable, with the result that a very expensive coil can be badly damaged or completely destroyed. Most superconducting magnet coils are hand wound, which necessarily entails a variable winding rate and sudden stops and starts. Sometimes, one or two turns must be removed and rewound. For these reasons, it is extremely important that tension be maintained in the superconducting cable under all of the conditions of variable and intermittent demand, associated with hand winding. Moreover, it is important to maintain the tension as constant as possible at the desired value, to avoid stretching of the cable.

SUMMARY OF THE INVENTION

Accordingly, one principal object of the present invention is to provide new and improved apparatus for producing constant tension in electrical cable or other strands, under conditions of intermittent demand, during unreeling or reeling operations.

Another object is to provide such new and improved apparatus, having means for adjusting the tension which is to be maintained.

It is a further object to provide such new and improved apparatus having means for measuring the tension in the cable or the like.

Another object is to provide such new and improved apparatus having fail safe means for preventing the cable or the like from unreeling, in the event of power failure.

To accomplish these and other objects, the present invention may provide apparatus for maintaining constant tension in a strand during unreeling and reeling thereof, said apparatus comprising a swing frame, a base, pivot means for pivotally supporting one portion of said swing frame on said base, a rotatable reel for holding a strand to be unreeled and reeled, reel supporting means rotatably supporting said reel on a second portion of said swing frame, a rotary drive motor, a drive train connected between said motor and said reel supporting means for transmitting torque to said reel to maintain tension in the strand during unreeling and reeling thereof, said drive train including a power controllable variable torque clutch, a servo transducer connected to said swing frame for sensing the position thereof and for producing servo input signals when said swing frame is moved in either direction from a predetermined position, a servo control system connected between said transducer and said clutch for regulating the torque transmitted by said clutch in relation to the signals from said transducer for maintaining said swing frame in said predetermined position, at least one fluid pressure operated force producing device connected to said swing frame for counteracting the tension in the strand as it is unreeled and reeled, and pressure source means for supplying a constant fluid pressure to said force producing device to establish and maintain constant tension in the strand, said servo control system and said clutch being effective to produce torque on said reel in an amount sufficient to produce tension in said strand corresponding to the constant force exerted by said force producing device.

The present invention is particularly applicable to the handling of superconducting cable and other electrical cable. References herein to such cable should be taken as including other applicable strands.

The clutch may take the form of an electrically controllable magnetic particle clutch which transmits increasing torque with increasing control current. The transducer may take the form of a potentiometer, which may be connected to a pivot shaft, swingable with the swing frame and constituting one component of the pivot means for the swing frame.

The drive train may include a fail safe brake operable to its released position by electrical power in common with the power for the servo control system and the motor, for preventing rotation of the reel in the event of failure of such electrical power.

The fluid pressure operated force producing device may take the form of a fluid cylinder, preferably an air cylinder. The pressure source means may include pressure regulating means for supplying a constant regulated fluid pressure to the fluid cylinder. Such regulating means may comprise an adjustable air pressure regulator for supplying constant air pressure. The regulator may be of the type which bleeds off excess pressure, as well as supplying additional air to prevent subnormal pressure.

The reel supporting means may include a reel shaft connected to the reel, bearings for the reel shaft, means supporting such bearings for limited lateral movement in the direction of the cable tension, force measuring devices engageable with such bearings for measuring the tension in the cable, a reel drive shaft connected to the drive train, and a coupling connected between the reel shaft and the drive shaft, such coupling being of a construction to transmit constant torque while accommodating the slight lateral movement of the reel shaft.

The pivot means may include a rotatable pivot shaft which is also a component of the drive train, which may include a chain drive between the rotatable pivot shaft and the reel drive shaft.

The apparatus may include spring means for biasing the swing frame toward its predetermined or initial position. Such spring means may include at least one pair of springs connected between the base and the swing frame and acting in opposite directions.

The apparatus may also include at least one shock absorber or snubber, connected between the base and the swing frame, to suppress any tendency of the swing frame to oscillate or vibrate about its predetermined or initial position. Such shock absorber may be of the hydraulic cylinder type.

With the apparatus of the present invention, a constant value of tension is maintained in the cable under conditions of intermittent demand. The torque supplied to the cable reel is regulated to maintain constant tension in the cable, irrespective of sudden stops and starts, and slow or more rapid demand. The tension is maintained constant when the cable is pulled off the reel, for use in winding a coil, for example. Moreover, the tension is also maintained constant if the cable is allowed to return to the reel, which may occur during coil winding operations, if a turn of the coil is removed from the coil and rewound in a better manner. The torque on the cable reel always tends to rewind the cable upon the reel. When the cable is pulled off the reel, the torque regulating clutch slips to accommodate the demand.

In case of an electrical power failure, the servo system ceases to operate, but the fail safe brake is engaged or set, by the loss of the electrical power, so that the cable reel is prevented from rotating.

BRIEF DESCRIPTION OF THE DRAWINGS

Further objects, advantages and features of the present invention will appear from the following description, taken with the accompanying drawings, in which.

DETAILED DESCRIPTION OF AN ILLUSTRATIVE EMBODIMENT

Figure 1:
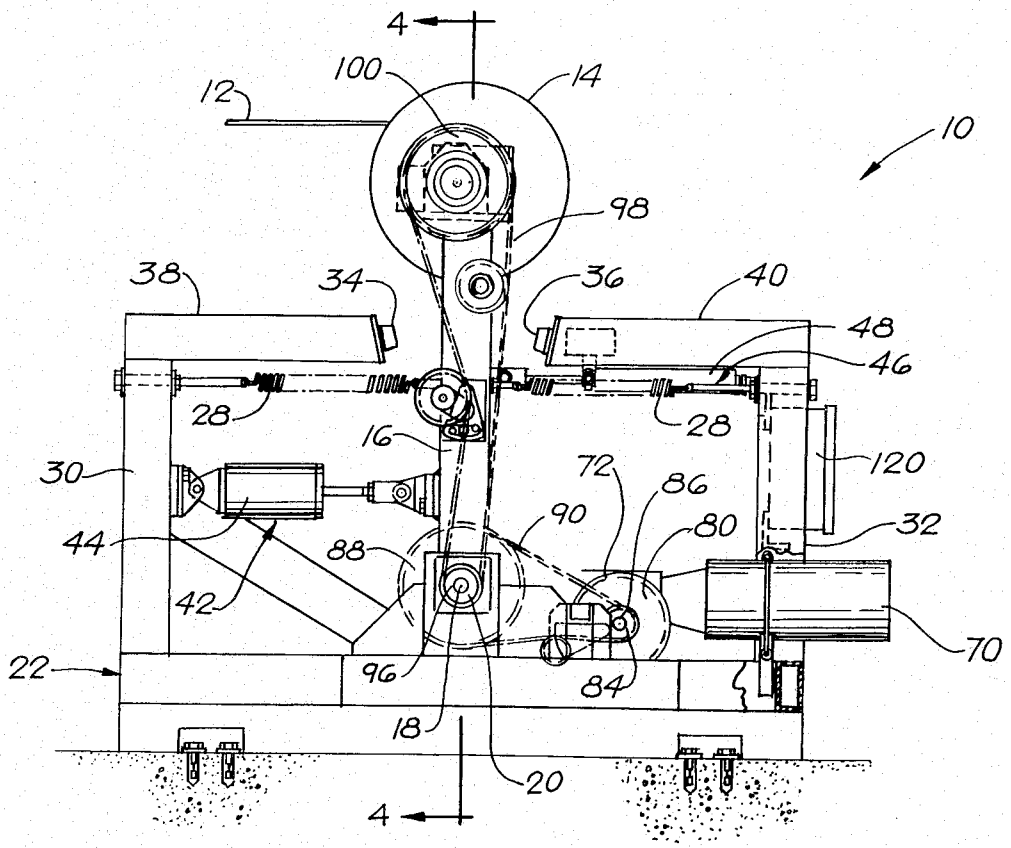
FIG. 1 is a somewhat diagrammatic elevational view of apparatus to be described as an illustrative embodiment of the present invention.
Figure 2:
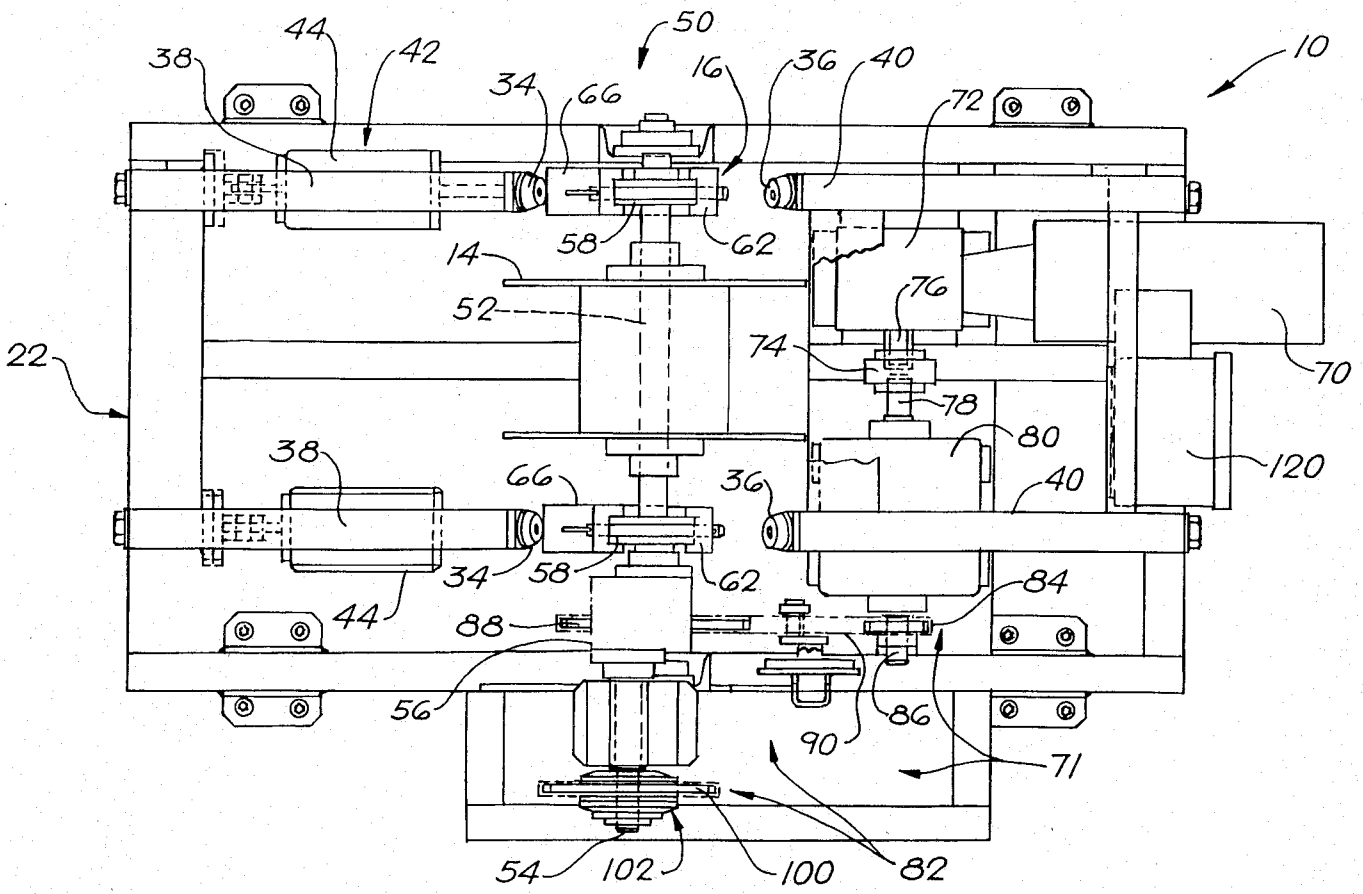
FIG. 2 is a somewhat diagrammatic plan view of the apparatus of FIG. 1.
Figure 4:
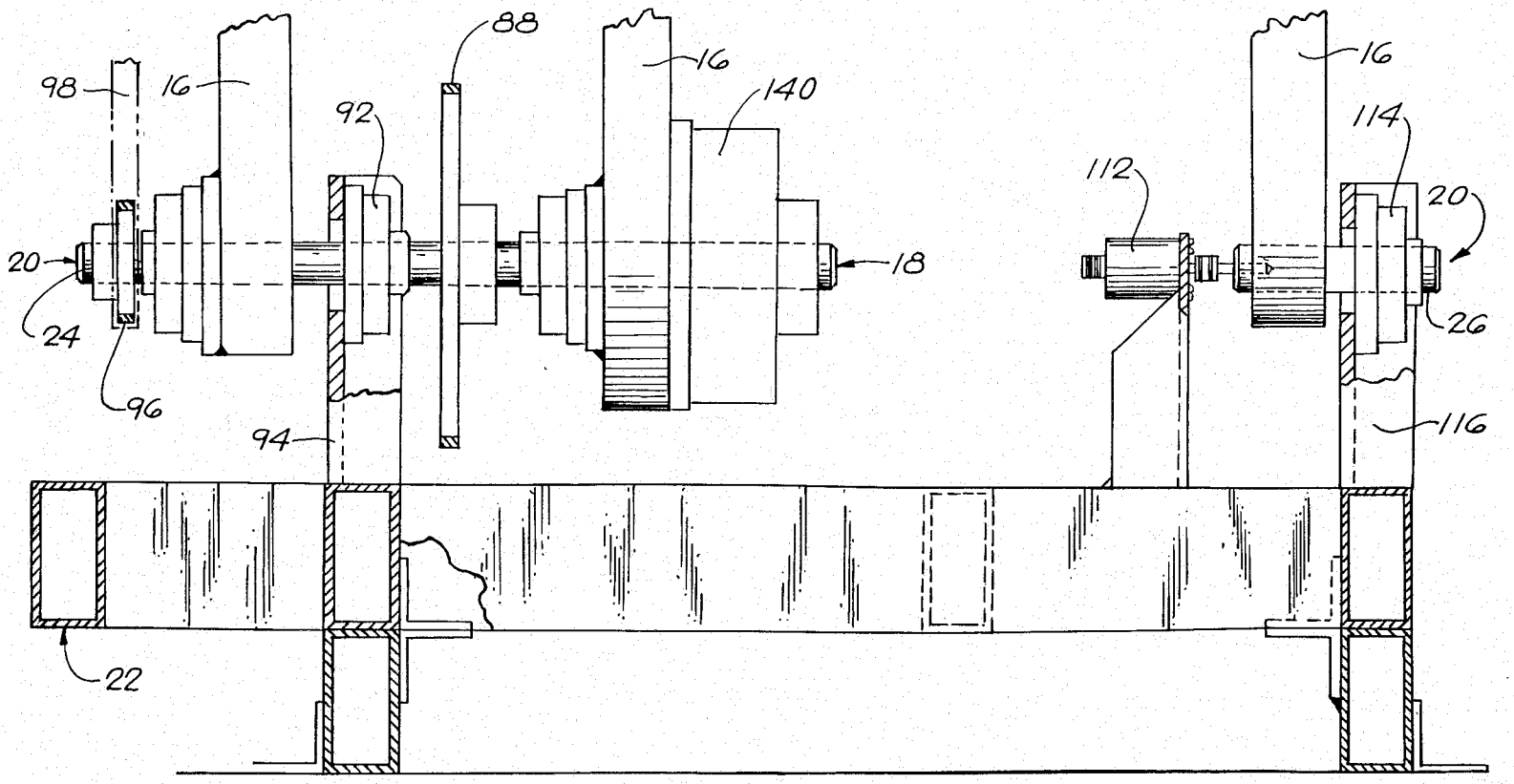
FIG. 4 is a fragmentary side elevation, partly in section, generally along the line 4—4 in FIG. 1.

As just indicated, FIGS. 1 and 2 illustrate apparatus 10 for maintaining constant tension in a cable or other strand 12, as it is unreeled or reeled from or to a cable reel or drum 14, which is generally in the shape of a spool. The reel 14 is rotatably mounted on a swing frame 16 which is preferably maintained in a generally vertical position and is swingable about a pivot axis 18. The swing frame 16 is supported for such swinging movement by pivot means 20, forming a pivotal connection between the lower portion of the swing frame 16 and a base or main frame 22. As shown in FIG. 4, the pivot means 20 may comprise pivot shafts 24 and 26, which will be described in greater detail presently.

As shown in FIGS. 1 and 2, the swing frame 16 is preferably biased toward an initial or predetermined position by spring means, shown as comprising two pairs of tension coil springs 28 connected between the swing frame 16 and upright side members 30 and 32 of the main frame 22. The swinging movement of the swing frame 16 is preferably limited by bumpers 34 and 36 on horizontal members 38 and 40 of the main frame 22.

The apparatus 10 preferably comprises force producing means 42 for counteracting and balancing the tension in the cable 12. Such force producing means 42 may take the form of two fluid cylinders, preferably air cylinders 44, connected between the swing frame 16 and the upright members 30 of the main frame 22. The air cylinders 44 may be of the low friction type.

The apparatus 10 also preferably comprises means 46 for suppressing or dampening any tendency of the spring frame 16 to oscillate or vibrate about its predetermined position. Such means 46 may take the form of an adjustable hydraulic shock absorber or snubber 48, connected between the swing frame 16 and one of the upright members 32 of the main frame 22.

Figure 3:
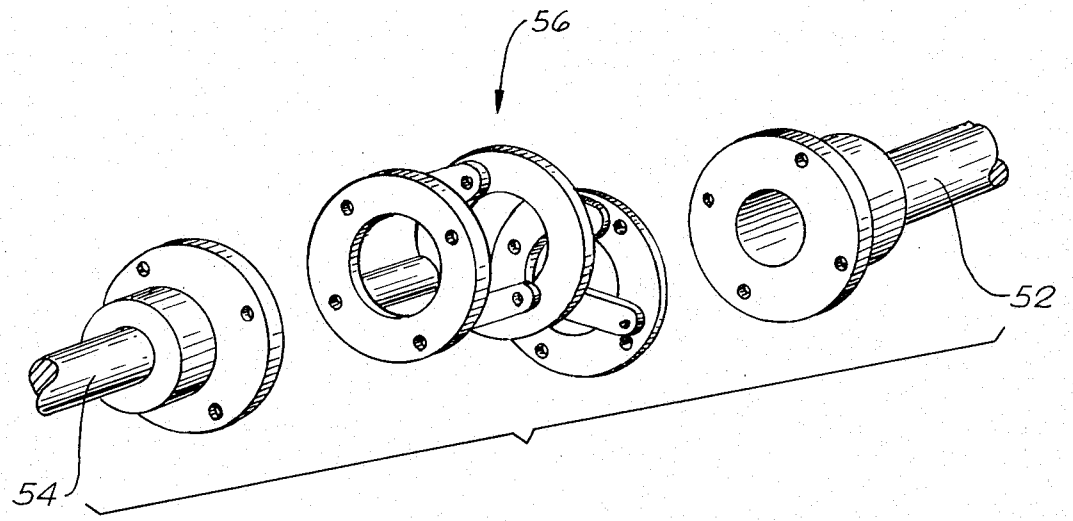
FIG. 3 is a diagrammatic perspective view of a coupling employed in such apparatus, to transmit constant torque while accommodating lateral movement of the cable reel, such coupling being shown partially disassembled for clarity of illustration.

As shown in FIGS. 1 and 2, the reel 14 is rotatably mounted on the upper portion of the swing frame 16 by reel supporting means 50, comprising a reel shaft 52 on which the reel 14 is mounted, a reel drive shaft 54, and a coupling 56 between the shafts 52 and 54, such coupling 56 being of a construction which transmits constant torque, but which accommodates slight lateral movement of the reel shaft 52. For example, the coupling 56 may be of the Schmidt coupler type, illustrated in FIG. 3. Any other known or suitable type of coupling may be employed.

Figure 5:
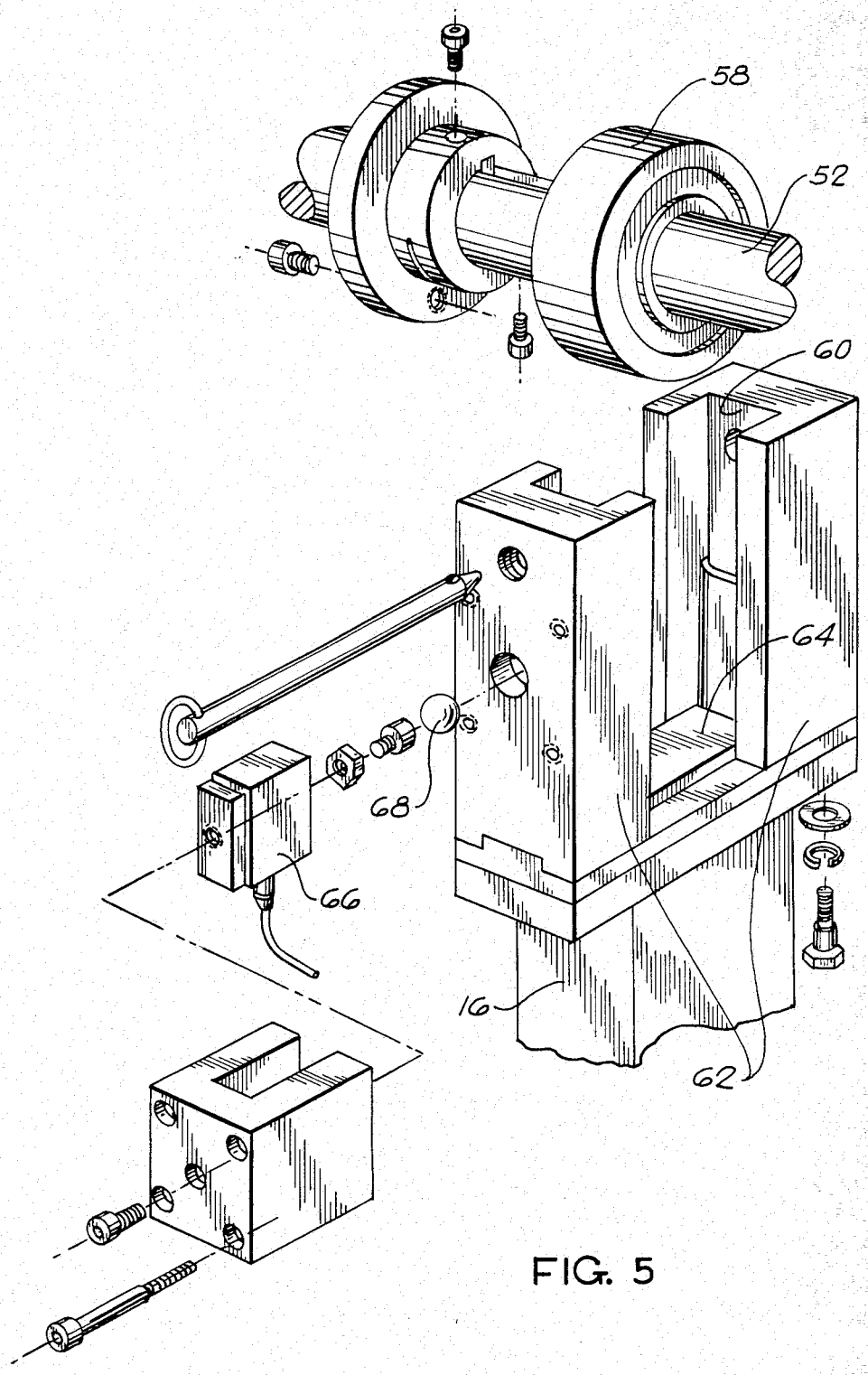
FIG. 5 is a fragmentary diagrammatic perspective view showing one of the movable bearings for the reel shaft, together with one of the force measuring devices, engageable with such bearing, such view showing the components partly disassembled for clarity of illustration.

As shown in FIG. 5, the reel shaft 52 is supported by bearings 58 which are supported on the upper end portion of the swing frame 16 for limited lateral movement in the direction of the tension in the cable 12. As shown, the bearings 58 are loosely received in grooves or recesses 60 formed in yoke structures 62 on the upper end portion of the swing frame 16. The bearings 58 are free to roll slightly in a lateral direction on supporting members 64 at the lower ends of the grooves 60.

The bearings 58 are engaged by force measuring devices 66, including balls 68 which transmit force between the bearings 58 and the force measuring devices 66. There are two of the bearings 58 and two of the force measuring devices 66. The sum of the forces measured by the force measuring devices 66 represents the tension being exerted between the cable 12 and the reel 14. This measuring arrangement has the advantage that the tension in the cable 12 is measured without any contact with the cable. Thus, there is no possibility of damaging the cable in measuring the tension therein. The force measuring devices 66 may comprise any known or suitable transducers for translating force into electrical signals. Such signals from the two force measuring devices 66 may be added together and supplied to an indicator or readout device, which may be of a digital type, to indicate the tension in the cable 12.

The apparatus 10 is provided with means for supplying torque to the cable reel 14, to resist the unreeling of the cable 12, so as to produce constant tension in the cable. If, during coil winding operations, the cable 12 is allowed to travel back toward the reel 14, the torque will cause reeling of the cable 12, under constant tension. Thus, both the unreeling and the reeling of the cable are carried out under constant tension in the cable 12.

The torque on the reel 14 is produced by power means, comprising a rotary electric motor 70 and a drive train 71 connected between the motor 70 and the reel 14. The drive train includes the reel shaft 52, the drive shaft 54, and the coupling 56, as well as a number of other components, which will now be described. The electric motor 70 is connected to a right-angle gear box 72, which may produce a speed reduction. A coupling 74 is connected between the output shaft 76 of the gear box 72, and the input shaft 78 of a variable torque transmitting clutch 80. The torque transmitted by the clutch 80 is subject to power control, preferably electrical control. Preferably, the clutch 80 takes the form of an electrically controllable magnetic particle clutch which is a slip clutch but transmits torque which increases as a function of increasing electrical current supplied to the clutch. The torque transmitted by the clutch 80 is regulated so as to maintain constant tension on the cable 12, whether it is being unreeled from the reel 14, or rereeled.

A chain drive 82 is provided between the output of the clutch 80 and the reel drive shaft 54. Such chain drive 82 comprises a sprocket 84 mounted on the output shaft 86 of the clutch 80, a second larger sprocket 88, and a chain 90 strung around the sprockets 84 and 88.

As shown in FIG. 4, the sprocket 88 is mounted on the previously mentioned shaft 24, which serves as one of the pivots for the swing frame 16. The shaft 24 is rotatably supported by a bearing 92, mounted on a bracket 94 secured to the main frame 22.

The shaft 24 carries a smaller sprocket 96, around which a second chain 98 is strung. The chain 98 is also strung around a larger sprocket 100, connected to the reel drive shaft 54. A torque limiting connection 102 may be provided between the sprocket 100 and the drive shaft 54.

The motor 70 rotates constantly and acts through the magnetic particle clutch 80 and the other components of the drive train 71 to produce torque on the reel 14, in such a direction as to tend to cause winding of the cable 12 upon the reel 14. The clutch 80 slips so as to allow unreeling of the cable 12 from the reel 14. The torque transmitted by the clutch 80 is regulated so as to maintain constant tension in the cable 12.

Figure 6:
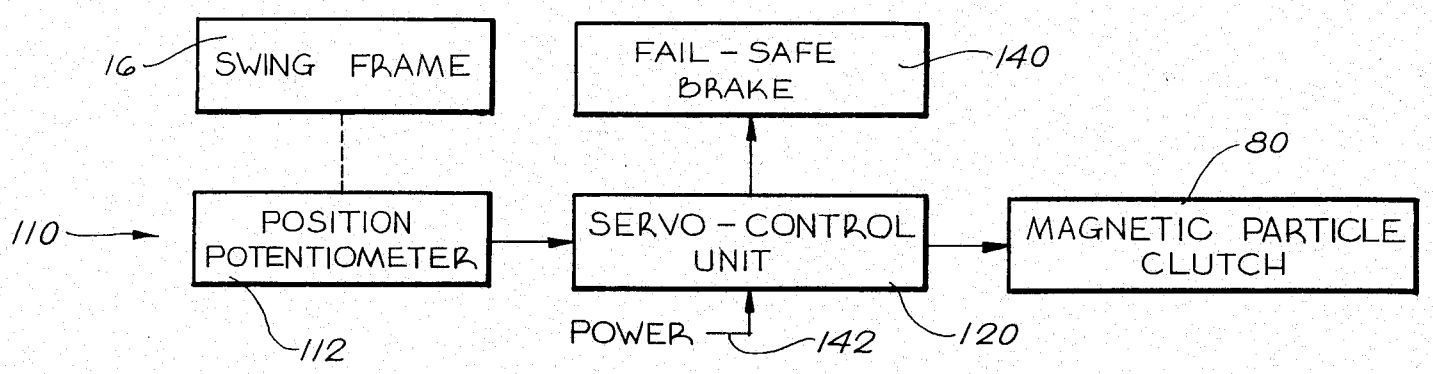
FIG. 6 is a block diagram, illustrating the servo control system for the apparatus of FIG. 1.
Figure 7:
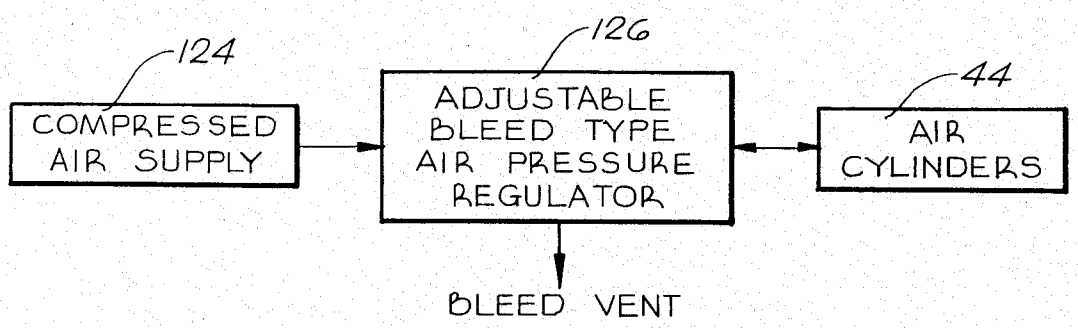
FIG. 7 is a block diagram, illustrating the air cylinders and the system for maintaining constant pressure in the air cylinders, for the apparatus of FIG. 1.

As shown in the block diagram of FIG. 6, the variable torque transmitting clutch 80 is one component of a servo system 110, which also includes a servo transducer 112 for sensing the position of the swing frame 16 and providing servo input signals, indicating such position. As shown in FIG. 4, the servo transducer 112 may take the form of a position indicating potentiometer, connected to the pivot shaft 26 for the swing frame 16. The pivot shaft 26 is swingable with the swing frame 16 and is rotatably supported by a bearing 114 mounted on a bracket 116, secured to the main frame 22.

The servo potentiometer or transducer 112 provides servo input signals which indicate any deviation in either direction from a predetermined position of the swing frame 16, to be maintained by the servo system 110.

The potentiometer 112 is connected to the input of a servo control unit or amplifier 120 having its output connected to the electrical input of the magnetic particle clutch 80. The servo control unit 120 is of a commercially available type which increases the input current to the magnetic particle clutch 80 when the position of the swing frame 16 deviates in one direction from the predetermined control position, while decreasing the input current to the clutch 80, when the position of the swing frame 16 deviates in the opposite direction from such predetermined position. In this way, the torque transmitted by the clutch 80 is regulated so as to maintain constant tension in the cable 12.

The air cylinders 44 are also involved in establishing and regulating the tension in the cable 12. The air cylinders 44 provide constant force in a direction to counterbalance the tension in the cable 12. Thus, as shown in FIG. 1, the air cylinders 44 tend to swing the swing frame to the right, while the tension in the cable 12 tends to swing the swing frame 16 to the left. The force exerted by the air cylinders 44 tends to counterbalance the tension in the cable 12.

The air cylinders 44 are supplied with compressed air under a constant pressure from a compressed air supply 124 by an adjustable bleed type air pressure regulator 126, connected between the compressed air supply 124 and the air cylinders 44. The regulator 126 provides constant air pressure to the air cylinders 44 under all conditions. If the air pressure in the cylinders 44 decreases slightly due to movement of the swing frame 16 to the right, or any other cause, the regulator 126 supplies additional compressed air, so as to restore and maintain the air pressure at a constant value in the air cylinders 44. If the pressure in the air cylinders 44 increases slightly due to movement of the swing frame 16 to the left, or any other cause, the regulator 126 bleeds off air from the air cylinders 44 so as to restore and maintain constant air pressure therein. Air pressure regulators of this type are known and available commercially.

The constant force exerted by the air cylinders 44 establishes the tension which is maintained in the cable 12 by the servo system 110. As previously indicated, the servo system 110 varies the current supplied to the magnetic particle clutch 80, so as to regulate the torque supplied to the cable reel 14, in such a manner that the swing frame 16 is maintained in its predetermined control position as sensed by the potentiometer 112. The torque supplied to the reel 14 is regulated to a value such as to produce tension in the cable 12 which will counterbalance the constant force exerted by the air cylinders 44. If the air pressure regulator 126 is readjusted so as to increase the force exerted by the air cylinders 44, the servo system 110 will increase the torque supplied to the reel 114, so as to increase the constant tension maintained on the cable 12. Conversely, if the air pressure regulator 126 is readjusted so as to decrease the constant force exerted by the air cylinders 44, the servo system 110 will decrease the torque supplied to the reel 14, so as to decrease the constant tension maintained in the cable 12. The combination of the constant force exerted by the air cylinders 44 and the regulating action of the servo system 110 produces constant tension in the cable 12 under conditions of variable and intermittent demand. Constant tension is maintained whether the cable 12 is being unreeled or reeled.

The apparatus 10 is preferably provided with a fail safe brake 140, as shown in FIG. 4, which prevents rotation of the cable reel or drum 14, in case there is a power failure in the supply of power to the servo system 110. The brake 140 may be electrically operated and may be constructed so that the brake is released when it is energized with electrical power, while being engaged or set when de-energized. As shown, the brake 140 is connected between the shaft 24 and the swing frame 16, so that the shaft 24 can not rotate when the brake 140 is set by the loss of electrical energization to the brake. As shown in FIG. 6, the servo system 110 and the fail safe brake 140 are energized from a common electrical power source 142. If there is a power failure, the servo system 110 ceases to operate, but the de-energization of the brake 140 causes it to be engaged, so that the shaft 24 can not rotate. Because of the chain drive 82 between the shaft 24 and the cable reel 14, rotation of the reel 14 is also prevented. Thus, the unreeling of cable from the reel 14 is prevented.

The servo control unit 120 may take the form of any known or suitable commercially available servo control unit, such as a Dynaweb unit No. EM101-1. The servo potentiometer 112 may also be any known or suitable commercially available unit, such as a Dynaweb position potentiometer No. EM101-3.

The magnetic particle clutch 80 may be any known or suitable commercially available unit, such as a Sperry clutch No. 50MCW90B.

The fail safe brake 140 may also be any known or suitable commercially available unit, such as an Electroid unit No. FSB-850-C-20-28V-L.

The air cylinders 44 may be of any known or suitable commercially available type, such as Bellowfram No. SS-12-F-SM-RC-CBM, for 125 PSI service.

During normal operation, the drum or reel 14 holds a supply of the cable 12 which is to be wound into coils, or otherwise used. The servo system 110 maintains the swing frame 16 in a predetermined control position, approximately as shown in FIG. 1, generally vertical and approximately midway between the bumpers 34 and 36. Constant tension is maintained on the cable 12. The electric motor 70 rotates continuously, and the magnetic particle clutch 80 continuously supplies torque to the reel 14 by way of the drive train 71. The torque is always in a direction tending to reel in or retrieve the cable 12. However, constant tension is maintained on the cable 12, whether it is being pulled off the reel 14, or if the cable 12 is stopped, or if the cable is allowed to return to the reel 14.

The amount of tension in the cable 12 is determined by the constant force exerted by the air cylinders 44 on the swing frame 16. This force counterbalances the tension in the cable 12. The tension maintained in the cable 12 can be adjusted by changing the force exerted by the air cylinders 44, which can be accomplished by readjusting the air pressure regulator 126 so as to increase or decrease the air pressure supplied to the air cylinders 44.

If the cable 12 is pulled off the reel 14, the swing frame 16 tends to swing or nod slightly to the left, as seen in FIG. 1. The servo system 110 interprets this slight swinging movement as an indication that the clutch 80 is transmitting too much torque to the reel 14. Accordingly, the slight movement of the swing frame 16 to the left changes the signal from the potentiometer 112 in such a direction that the servo control unit 120 reduces the electrical current supplied to the clutch 80, so that the torque transmitted by the clutch is slightly reduced. As a result, the swing frame 16 returns to its predetermined control position.

If the cable 12 is allowed to return to the reel 14, the swing frame 16 nods or swings slightly to the right, as seen in FIG. 1. The servo system 110 interprets such movement of the swing frame 16 as an indication that not enough torque is being transmitted to the reel 14 by the clutch 80. Accordingly, the slight swinging movement of the swing frame 16 to the right causes the signal from the potentiometer 112 to change in such a direction that the servo control unit 120 increases the current supplied to the clutch 80, so that it develops a greater torque and causes the swing frame 16 to return to its predetermined control position. The action of the servo system 110 is very fast and effective, so that the slight swinging movement of the swing frame 16 is hardly noticeable.

The shock absorber or snubber 48 dampens or suppresses any tendency of the swing frame 16 to oscillate or vibrate about its predetermined control position.

If there is a power failure, the servo system 110 ceases to operate, but the loss of power causes the fail safe brake 140 to be engaged, so that rotation of the cable reel 14 is prevented.

The apparatus 10 is particularly well adapted for unreeling the cable 12 under conditions of intermittent and variable demand, which condition prevails when the cable 12 is superconducting cable and is being used for winding coils by hand or by a hand powered machine. Under these conditions, the rate at which the cable 12 is unreeled is highly variable, and the cable 12 is subject to sudden starts and stops. Moreover, at times some of the cable 12 is unwound temporarily from the coil, so that the cable may be rewound on the coil in a different manner. Under all of these conditions of variable and intermittent demand, the aparatus 10 maintains a constant amount of tension in the cable 12.

The shock absorber 48 may be of the adjustable double-acting type. The springs 28 are adapted to absorb a 100 pound jerk, while preventing the swing frame 16 from bottoming out against the bumpers 34 or 36.

By readjusting the air pressure regulator 126, the constant amount of air pressure supplied to the air cylinders 24 can be changed. In this way, the amount of tension maintained in the cable can be varied over a wide range, such as from 70 to 300 pounds.

The tension in the cable 12 is measured by measuring the forces exerted by the two bearings 58 against the force measuring devices 66. The bearings 58 support the shaft 52 on which the cable reel 14 is mounted. The bearings 58 and the shaft 52 are movable laterally to a slight extent in the grooves 60 formed in the yokes 62. Such movement is accommodated by the Schmidt coupler 56. The force signals from the two force measuring devices 66 are added together and are displayed, as by a digital display, to indicate the tension in the cable 12.

The tension in the cable is measured without touching the cable, so that there is no possibility of causing mechanical deformation of the cable. This is particularly important when the apparatus 10 is used with superconducting cable, which must be protected from mechanical deformation.

In addition to being highly advantageous for handling superconducting electrical cable, the apparatus of the present invention is useful for controlling and maintaining tension in other strands, such as wire, cord, cable, fish line, wrapping paper, and numerous other materials. Another use is in testing, to insure the integrity of wire, small cable, fish line and other strands which are guaranteed to withstand a definite amount of tension.

The apparatus of the present invention is also well adapted to be employed with a second apparatus of the same construction, to transfer cable from one spool to another. This operation allows the transfer of the cable from a spool of one size to a spool of another size, while maintaining a constant amount of tension. This mode of operation also makes it possible to increase the tension as the cable is rewound from one spool to another spool. This can be done, back and forth, until a high cable tension is achieved on one of the spools. By this back and forth method, with gradually increasing tension, any slippage or skidding between individual cable turns is avoided, so as to avoid damage to sensitive insulation.

What is claimed is:

1. Apparatus for maintaining constant cable tension during unreeling and reeling of electrical cable, said apparatus comprising a generally vertical swing frame, a base, pivot means for pivotally supporting the lower end of said swing frame on said base, a rotatable cable reel for holding cable to be unreeled and reeled, reel supporting means rotatably supporting said reel on the upper portion of said swing frame, a rotatable drive shaft on said swing frame and coupled to said reel supporting means, a rotary motor on said base, a drive train connected between said motor and said drive shaft for transmitting torque to said reel to maintain tension on the cable during unreeling and reeling thereof, said drive train including an electrically controllable variable torque slip clutch, spring means connected between said swing frame and said base for biasing said swing frame toward an initial operating position, a servo transducer connected to said swing frame for sensing the position thereof and for producing servo input signals when said swing frame is moved in either direction from said initial position, a servo control system connected between said transducer and said clutch for regulating the torque transmitted by said clutch in relation to the signals from said transducer for maintaining said swing frame in said initial position, at least one fluid cylinder connected between said base and said swing frame for counteracting the tension in the cable as it is unreeled and reeled from said reel, and pressure regulating means for supplying a constant fluid pressure to said fluid cylinder to establish and maintain constant tension in the cable, said servo system and said clutch being effective to produce torque on said reel in an amount sufficient to provide tension in said cable corresponding to the constant force exerted by said fluid cylinder.

2. Apparatus according to claim 1, in which said clutch takes the form of an electrically controllable magnetic particle clutch.

3. Apparatus according to claim 1, in which said servo transducer take the form of a potentiometer.

4. Apparatus according to claim 1, in which said drive train includes a fail safe brake operable to its released position by electrical power in common with said servo control system and said motor, for preventing rotation of said reel in event of failure of such power.

5. Apparatus according to claim 1, in which said fluid cylinder takes the form of an air cylinder, said regulating means taking the form of a variable air pressure regulator for supplying constant air pressure to said cylinder, said regulator being variable to change the value of the constant air pressure so as to change the tension which is maintained in the cable.

6. Apparatus according to claim 1, said regulating means being adjustable to change the value of the constant pressure supplied to said cylinder, so as to change the tension maintained in the cable.

7. Apparatus according to claim 1, said reel supporting means including a reel shaft, bearings rotatably supporting said reel shaft, means supporting said bearings for limited lateral movement in the direction of the cable tension, and force measuring devices engageable with said bearings for measuring the tension in the cable.

8. Apparatus according to claim 7, including a coupling connected between said reel shaft and said drive shaft, said coupling being of a construction to transmit torque between said drive shaft and said reel shaft while accommodating the slight lateral movement of the reel shaft.

9. Apparatus according to claim 1, said pivot means including a rotatable pivot shaft which is also a component of said drive train, said drive train including a chain drive between said rotatable pivot shaft and said drive shaft.

10. Apparatus according to claim 1, said pivot means including a pivot shaft which is swingable with said swing frame, said transducer being connected to said pivot shaft.

11. Apparatus for maintaining constant cable tension during unreeling and reeling of electrical cable, said apparatus comprising a swing frame, a base, pivot means for pivotally supporting one end of said swing frame on said base, a rotatable cable reel for holding cable to be unreeled and reeled, reel supporting means rotatably supporting said reel on the other end portion of said swing frame, a rotary drive motor, a drive train connected between said motor and said reel supporting means for transmitting torque to said reel to maintain tension on the cable during unreeling and reeling thereof, said drive train including a power controllable variable torque clutch, a servo transducer connected to said swing frame for sensing the position thereof and for producing servo input signals when said swing frame is moved in either direction from a predetermined position, a servo control system connected between said transducer and said clutch for regulating the torque transmitted by said clutch in relation to the signals from said transducer for maintaining said swing frame in said predetermined position, at least one fluid pressure operated force producing device connected between said base and said swing frame for counteracting the tension in the cable as it is unreeled and reeled, and pressure source means for supplying a constant fluid pressure to said force producing device to establish and maintain constant tension in the cable, said servo control system and said clutch being effective to produce torque on said reel in an amount sufficient to provide tension in said cable corresponding to the constant force exerted by said force producing device.

12. Apparatus according to claim 11, including spring means biasing said swing frame toward said predetermined position.

13. Apparatus according to claim 11, in which said drive train includes a fail safe brake operable to its released position by electrical power in common with said servo control system for preventing rotation of said reel in the event of failure of such power.

14. Apparatus according to claim 11, including a shock absorber connected between said swing frame and said base to suppress any tendency of said swing frame to oscillate or vibrate about said predetermined position.

15. Apparatus according to claim 11, said reel supporting means including a reel shaft supporting said reel, a rotatable drive shaft, a coupling device therebetween, bearings rotatably supporting said reel shaft, means supporting said bearings for limited lateral movement in the direction of the cable tension, and force measuring devices engageable with said bearings for measuring the tension in the cable, said coupling device being of a construction to transmit torque while accommodating the slight lateral movement of the reel shaft.

16. Apparatus for maintaining constant tension in a strand during unreeling and reeling thereof, said apparatus comprising a swing frame, a base, pivot means for pivotally supporting one portion of said swing frame on said base, a rotatable reel for holding a strand to be unreeled and reeled, reel supporting means rotatably supporting said reel on a second portion of said swing frame, a rotary drive motor, a drive train connected between said motor and said reel supporting means for transmitting torque to said reel to maintain tension in the strand during unreeling and reeling thereof, said drive train including a power controllable variable torque clutch, a servo transducer connected to said swing frame for sensing the position thereof and for producing servo input signals when said swing frame is moved in either direction from a predetermined position, a servo control system connected between said transducer and said clutch for regulating the torque transmitted by said clutch in relation to the signals from said transducer for maintaining said swing frame in said predetermined position, at least one fluid pressure operated force producing device connected to said swing frame for counteracting the tension in the strand as it is unreeled and reeled, and pressure source means for supplying a constant fluid pressure to said force producing device to establish and maintain constant tension in the strand, said servo control system and said clutch being effective to produce torque on said reel in an amount sufficient to provide tension in said strand corresponding to the constant force exerted by said force producing device.

17. Apparatus according to claim 16, including spring means biasing said swing frame toward said predetermined position.

18. Apparatus according to claim 16, in which said drive train includes a fail-safe brake operable to its released position by electrical power in common with said servo control system for preventing rotation of said reel in the event of failure of such power.

19. Apparatus according to claim 16, including a shock absorber connected to said swing frame to suppress any tendency of said swing frame to oscillate or vibrate about said predetermined position.

20. Apparatus according to claim 16, said reel supporting means including a reel shaft, supporting said reel, a rotatable drive shaft, a coupling device therebetween, bearings rotatably supporting said reel shaft, means supporting said bearings for limited lateral movement in the direction of the cable tension, and force measuring devices engageable with said bearings for measuring the tension in the cable, said coupling device being of a construction to transmit torque while accommodating the slight lateral movement of the reel shaft.

* * * * *